US005470295A

United States Patent [19]

Wang

[11] Patent Number: 5,470,295

[45] Date of Patent: Nov. 28, 1995

[54] ROWING EXERCISE MACHINE

[76] Inventor: Chin-Liu Wang, No. 6, Lane 308, Shyue Shyh Road, Taichung, Taiwan

[21] Appl. No.: 399,650

[22] Filed: Mar. 7, 1995

[51] Int. Cl.[6] ..... A63B 21/00

[52] U.S. Cl. ..... 482/71; 482/96

[58] Field of Search ..... 482/72, 95, 96, 482/130, 133, 135, 136, 139, 148, 142, 57, 70, 71, 73

[56] References Cited

U.S. PATENT DOCUMENTS

| | | | |
|---|---|---|---|
| 3,380,737 | 4/1968 | Elia et al. | 482/72 |
| 4,300,760 | 11/1981 | Bobroff | 482/96 |
| 5,295,931 | 3/1994 | Dreibelbis et al. | 482/72 |
| 5,370,594 | 12/1994 | Grinblat | 482/72 |

FOREIGN PATENT DOCUMENTS

| | | | |
|---|---|---|---|
| 0161441 | 9/1904 | Germany | 482/72 |

*Primary Examiner*—Stephen R. Crow
*Attorney, Agent, or Firm*—Browdy and Neimark

[57] ABSTRACT

A rowing exercise machine comprises a base, a first swinging member, a second swinging member, a seat tube, a seat, a third swinging member, a first pulley, a second pulley, a pull cable, a hand grip, and two pedals. A rowing exercise is brought about by a person sitting on the seat of the rowing exercise machine, with the person's feet pedaling the pedals and the person's hands holding the hand grip to pull rearwards the pull cable to cause the first swinging member and the third swinging member to move closer so as to actuate the seat tube to move upwards and rearwards. As the pull cable is relieved of the pressure exerting thereon, the seat tube is caused by the person's weight to move forwards and downwards so as to actuate the first swinging member and the third swinging member to move away from each other in opposite directions.

7 Claims, 3 Drawing Sheets

ROWING EXERCISE MACHINE

FIELD OF THE INVENTION

The present invention relates generally to an exercise machine, and more particularly to a rowing exercise machine.

BACKGROUND OF THE INVENTION

The conventional rowing exercise machine comprises a damper provided with an oil pressure cylinders, which are rather expensive and are vulnerable to oil leak.

SUMMARY OF THE INVENTION

It is therefore the primary objective of the present invention to provide a rowing exercise machine comprising a damper without the oil pressure cylinders.

The foregoing objective of the present invention is attained by a rowing exercise machine comprising a base, a first swinging member, a second swinging member, a seat tube, a seat, a third swinging member, a first pulley, a second pulley, a pull cable, a hand grip, and two pedals. A rowing exercise is brought about by a person sitting on the seat of the rowing exercise machine, with his or her feet pedaling the pedals and both hands holding the hand grip to pull rearwards the pull cable to cause the first swinging member and the third swinging member to move closer so as to actuate the seat tube to move upwards and rearwards. As the pull cable is relieved of the pressure exerting thereon, the seat tube is caused by the weight of the exerciser to move forward and downwards so as to actuate the first swinging member and the third swinging member to move away from each other in opposite directions.

DETAILED DESCRIPTION OF THE INVENTION

Figure 1:
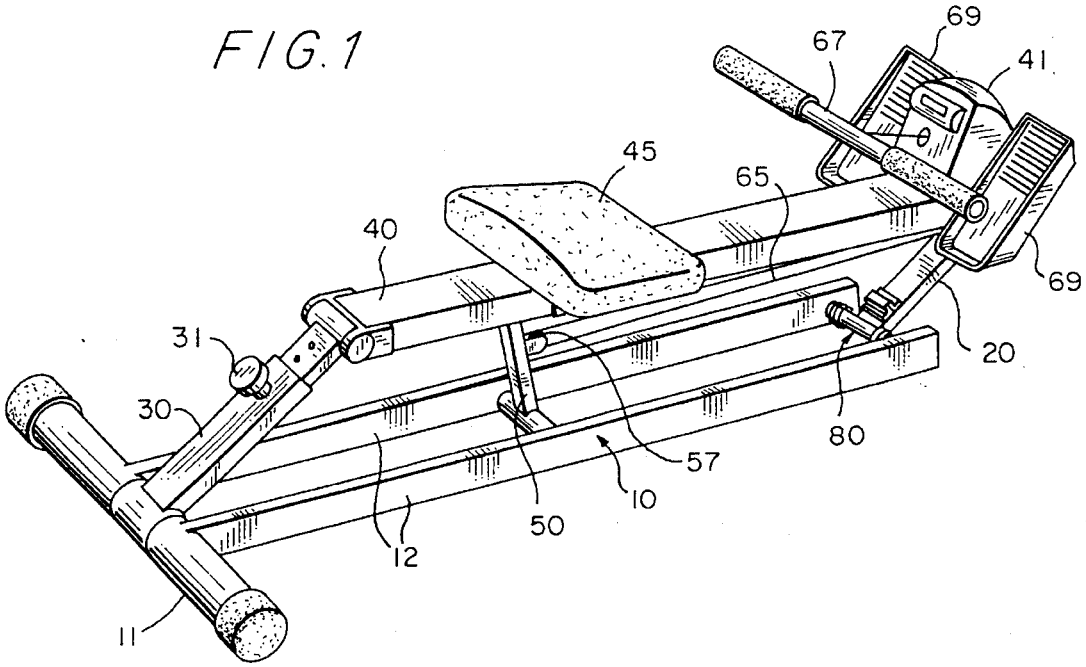
FIG. 1 shows a perspective view of the present invention.
Figure 2:
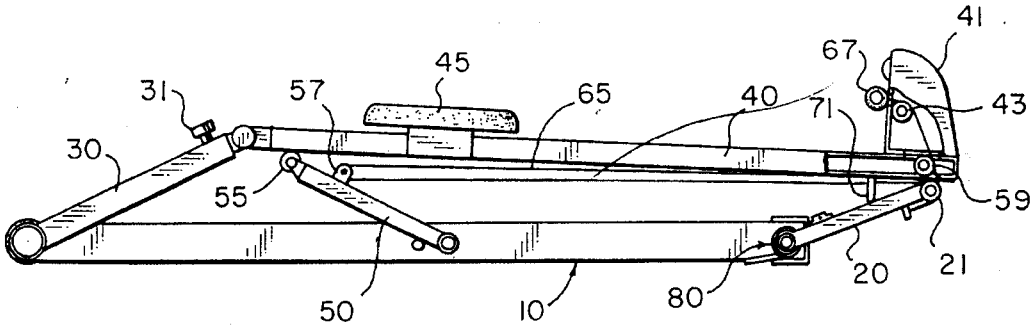
FIG. 2 shows a front view of the present invention.
Figure 3:
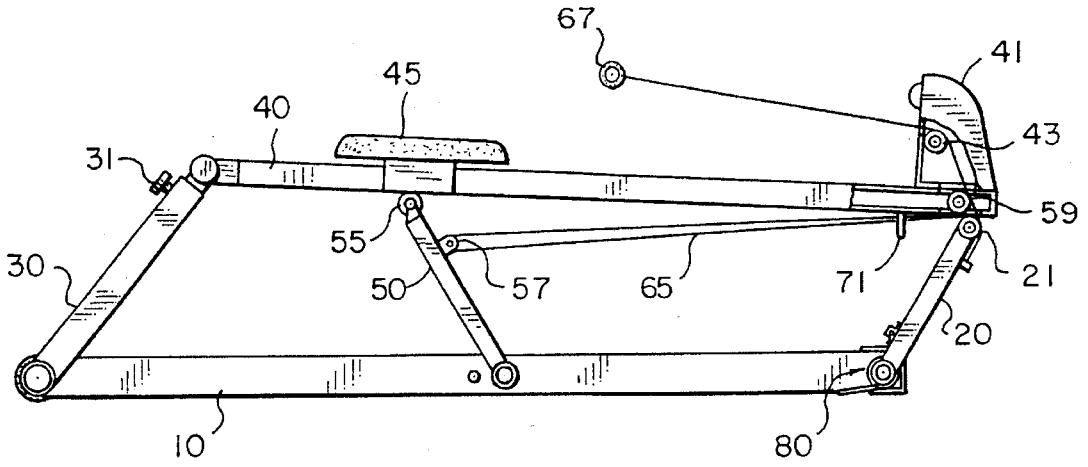
FIG. 3 shows a schematic view of the present invention at work.

As shown in FIGS. 1–7, a rowing exercise machine of the present invention comprises the component parts which are described hereinafter.

A base 10 has a support rod 11 and two horizontal rods 12 which are fastened respectively at one end thereof with the support rod 11 in such a manner that the two horizontal rods 12 are parallel to each other.

A first swinging member 20 of a long and tubular construction is pivoted at one end thereof to the base 10 such that the first swinging member 20 is located between the free ends of the two horizontal rods 12, and that the first swinging member 20 is capable of swinging freely.

A second swinging member 30 of a long and tubular construction is pivoted at one end thereof to a midpoint of the support rod 11 and has a length greater than or equal to the length of the first swinging member 20.

A seat tube 40 is pivoted respectively at both ends thereof to the first swinging member 20 and the second swinging member 30 so as to form a connection rod set comprising the base 10 as a fixation rod, two swinging members 20 and 30 as two rocking bars, and the seat tube 40 as a corner rod.

A seat 45 is fastened to the midsegment of the seat tube 40.

A third swinging member 50 is pivoted at one end thereof to the base 10 such that the third swinging member 50 is located between the two horizontal rods 12, and that the third swinging member 50 is capable of swinging freely. The third swinging member 50 is longer than the second swinging member 30.

A wheel 55 is fastened pivotally with the free end of the third swinging member 50 such that the wheel 55 is capable of making contact with the underside of the seat tube 40.

A first pulley 57 is mounted on one side of the third swinging member 50 such that the first pulley 57 faces the first swinging member 20.

A second pulley 59 is mounted on the seat tube 40 such that the second pulley 59 is adjacent to the first swinging member 20.

A pull cable 65 is fastened at one end thereof with the first swinging member 20 such that another end of the pull cable 65 is wound first on the first pulley 57 and then on the second pulley 59.

A hand grip 67 is fastened with one end of the pull cable 65.

Two pedals 69 are fastened respectively to both sides of the front end of the seat tube 40.

A locating member 71 of a U-shaped construction is fastened to the underside of the front end of the seat tube 40 such that the locating member 71 is engageable with the first swinging member 20 for confining the angle of the lower stopping point formed between the first swinging member 20 and the seat tube 40. According to the present invention, the angle referred to above is twenty degrees.

Figure 4:
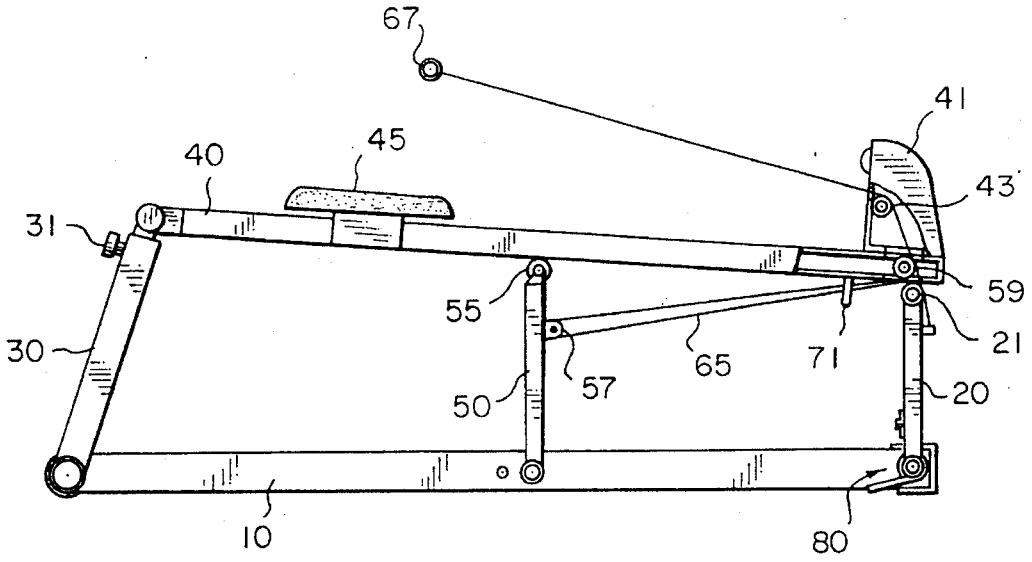
FIG. 4 is another schematic view of the present invention at work, showing that the pull cable is located at an upper stopping point.

In operation, an exerciser is seated on the seat 45, with his or her feet pedaling the pedals 69 and with his or her hands holding the hand grip 67 to pull rearwards the pull cable 65 so as to cause the third swinging member 50 and the first swinging member 20 to move closer. As a result, the seat 45 is moved upwards and rearwards. As the exerciser keeps pulling the pull cable 65, the swinging angle of the third swinging member 50 becomes greater. In view of the fact that the third swinging member 50 is longer than the second swinging member 30 and that the second swinging member 30 is longer than or equal in length to the first swinging member 20, the third swinging member 50 is not able to continue swinging rearwards when the first swinging member 20 is located vertically at an upper stopping point, as shown in FIG. 4.

Figure 5:
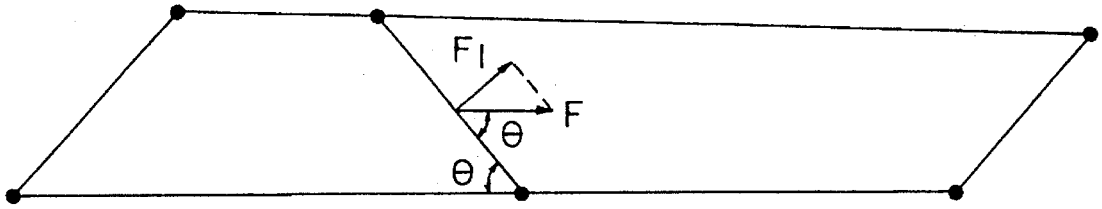
FIG. 5 is a diagram illustrating the action of stress.

As illustrated in FIG. 5, F stands for a force of the pull cable 65 exerting on the third swinging member 50 while θ stands for the angle formed by the third swinging member 50 and the base 10, the effective component of force F1 is equal to FSIN θ. At the beginning, θ is small, and the effective component of force is therefore small. For this reason, the exerciser must exert a greater force on the pull cable 65 at the beginning of the exercise. As the exerciser keeps pulling the pull cable 65, the exerciser is required to exert a smaller force on the pull cable 65. As a result, a rowing exercise is brought about.

Figure 6:
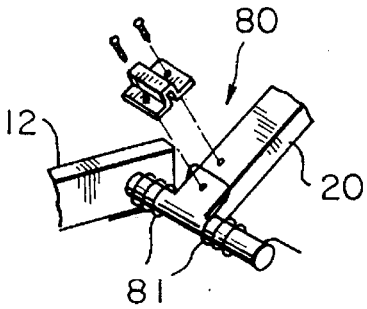
FIG. 6 shows a perspective view of a compensating device of the present invention.
Figure 7:
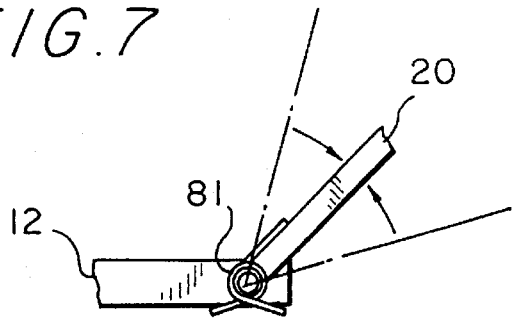
FIG. 7 shows a schematic view of the compensating device in action according to the present invention.

As shown in FIGS. 6 and 7, the rowing exercise machine of the present invention is provided with a compensating device 80 comprising two torsion springs 81 which are fitted respectively over the first swinging member 20, the second swingin member 30, or the third swinging member 50. According to the preferred embodiment of the present invention, the torsion springs 81 are fitted respectively over the two pivots located at the bottom end of the first swinging member 20. The torsion springs 81 are fastened respectively at one end thereof with the horizontal rod 12 and at another end thereof with the first swinging member 20, which has a predetermined angle of zero, 30 degrees, or 45 degrees, etc. When the first swinging member 20 is caused to swivel downwards to reach the lower stopping point by the weight of an exerciser sitting on the seat 45, the torsion springs 81 are provided respectively with a bouncing force capable of assisting the first swinging member 20 to swivel upwards when the pull cable 65 is pulled by the exerciser. When the first swinging member 20 is caused to swivel beyond the zero position, the torsion springs 81 are provided respectively with a reverse bouncing force. At this time, the exerciser may exert a greater force on the pull cable 65.

The second swinging member 30 may be constructed as an expansible tube fastened by a locating member 31. The exerciser may alter the magnitude of exertion force by adjusting the length of the second swinging member 30. The magnitude of the required exertion force is in an inverse proportion to the length of the second swinging member 30.

The first swinging member 20 may be provided with a third pulley 21 and a plurality of locating holes locating in the side facing outwards. The pull cable 65 is fastened to any one of the locating holes via the third pulley 21 for facilitating the adjusting of the length of the pull cable 65.

The seat tube 40 is provided on the top thereof with a housing 41 in which a fourth pulley 43 is disposed to facilitate a change in the height at which the pull cable 65 is pulled out. The pull cable 65 has one end which is put through the housing 41 via the fourth pulley 43. The housing 41 may be provided thereon with an instrument or device.

What is claimed is:

1. A rowing exercise machine comprising:

a base;

a first swinging member fastened pivotally at one end thereof with said base;

a second swinging member fastened pivotally at one end thereof with said base and having a length greater than or equal to a length of said first swinging member;

a seat tube fastened pivotally at one end thereof with said first swinging member and at another end thereof with said second swinging member;

a seat located securely on said seat tube;

a third swinging member fastened pivotally at one end thereof with said base such that said third swinging member is located between said first swinging member and said second swinging member which is shorter than said third swinging member;

a first pulley mounted on a predetermined position of said third swinging member;

a second pulley mounted on said seat tube such that said second pulley is adjacent to said first swinging member;

a pull cable fastened at one end thereof with said first swinging member and wound at another end thereof on said first pulley and said second pulley before said another end of said pull cable is extended toward said seat;

a hand grip fastened to said another end of said pull cable; and two pedals mounted respectively on both sides of said seat tube such that said two pedals are adjacent to said first swinging member.

2. The rowing exercise machine as defined in claim 1, wherein said second swinging member is provided on a top end thereof with a wheel engageable with an underside of said seat tube.

3. The rowing exercise machine as defined in claim 1, wherein at least one of said swinging members may be provided with a compensating device comprising two torsion springs which are fitted respectively over two pivots of said swinging member such that said torsion springs are fastened respectively at one end thereof with said base and at another end thereof with said swinging member, and that said torsion springs are capable of causing said swinging member to swivel up and down to bring about a bouncing force capable of causing said swinging member to swivel a predetermined angle.

4. The rowing exercise machine as defined in claim 1 further comprising a locating member disposed between said seat tube and said first swinging member for locating said first swinging member when said first swinging member is caused to swivel so as to form a predetermined angle with said seat tube.

5. The rowing exercise machine as defined in claim 1, wherein said second swinging member is an expansible tube adjustable in length for adjusting the magnitude of an exertion force of an exerciser sitting on said seat.

6. The rowing exercise machine as defined in claim 1, wherein said first swinging member is provided at a top thereof with a third pulley and is further provided with a plurality of locating holes for locating one end of said pull cable wound on said third pulley, so as to facilitate the changing of the length of said pull cable.

7. The rowing exercise machine as defined in claim 1, wherein said seat tube is provided with a housing which is adjacent to said first swinging member and is provided therein with a fourth pulley on which said pull cable is wound in such a manner that another end of said pull cable is extended through said housing.

* * * * *